United States Patent [19]

Mulcahy

[11] 4,454,909

[45] Jun. 19, 1984

[54] MOLD STATOR FOR ELECTROMAGNETIC STIRRING

[75] Inventor: Joseph A. Mulcahy, Brooklin, Canada

[73] Assignee: Co-Steel International Limited, Whitby, Canada

[21] Appl. No.: 231,480

[22] Filed: Feb. 4, 1981

Related U.S. Application Data

[63] Continuation-in-part of Ser. No. 130,066, Mar. 13, 1980, abandoned.

[51] Int. Cl.[3] ..... B22D 27/02

[52] U.S. Cl. ..... 164/504; 164/468

[58] Field of Search ..... 164/468, 499, 504, 507, 164/147.1

[56] References Cited

U.S. PATENT DOCUMENTS

| | | | |
|---|---|---|---|
| 2,319,402 | 5/1943 | Hever | 268/234 |
| 3,135,739 | 5/1973 | Karlson | 164/468 |
| 3,621,103 | 11/1971 | Campbell | 259/DIG. 46 |
| 3,941,183 | 3/1976 | Vedda et al. | 164/468 |
| 4,026,346 | 5/1977 | Birat et al. | 164/468 |
| 4,150,712 | 4/1979 | Dussart | 164/468 |
| 4,183,395 | 1/1980 | Kollberg | 164/504 |
| 4,200,137 | 4/1980 | Zavaros et al. | 164/468 |

FOREIGN PATENT DOCUMENTS

| | | |
|---|---|---|
| 1583601 | 9/1970 | Fed. Rep. of Germany . |
| 1565415 | 1/1971 | Fed. Rep. of Germany . |
| 1517887 | 7/1978 | United Kingdom . |

*Primary Examiner*—Kuang Y. Lin
*Assistant Examiner*—Richard K. Seidel
*Attorney, Agent, or Firm*—Robert L. Westell; Harold H. Dutton, Jr.

[57] ABSTRACT

A means for electromagnetic stirring of steel in a continuous casting operation comprises at least two multi-turn conducting loons. Each turn has a group of winding segments running longitudinally along a mould side, such connected in series to another group of segments running longitudinally along the opposite mould side. Such an arrangement provides a rotating field which produces flux across the mould, transverse to the casting direction.

13 Claims, 13 Drawing Figures

MOLD STATOR FOR ELECTROMAGNETIC STIRRING

Figure 1:
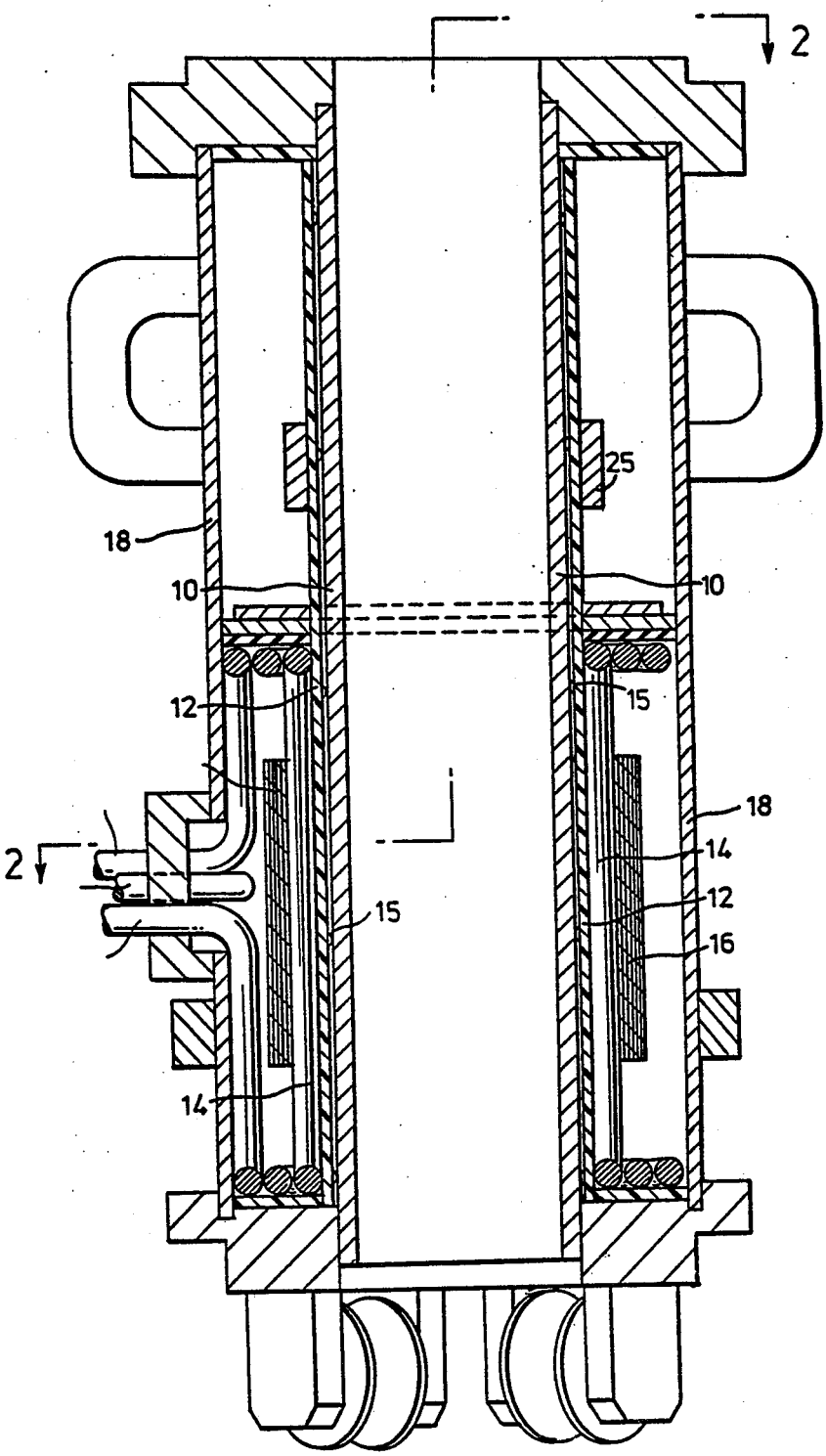

This application is a continuation-in-part of an application Ser. No. 130,066 filed Mar. 13, 1980, now abandoned.

This invention relates to electromagnetic stirring apparatus for the provision of a magnetic field rotating about the path of steel through a continuous casting mold, the purpose of such field being to cause rotation of the steel which is still liquid in the mold.

Prior apparatus of this type has included, in addition to the windings and power sources to produce the field, pole pieces or teeth of magnetically permeable material, extending between the windings or some of them, toward the mold. Such pole pieces or teeth have a useful function in other applications, e.g. in the stator of an A.C. motor where the teeth or pole pieces reduce the air gap between the stator (composed of such teeth or pole pieces and an outer magnetically permeable path) and a rotor mainly formed of magnetically permeable material. However, in the electromagnetic stirring of steel the role of the "rotor" is replaced by the liquid steel being cast and this is substantially nonmagnetic. Accordingly, the air gap is, relatively, extremely large, being greater than the transverse dimension of the mold. With the magnitude of the air gap, in the electromagnetic stirring of steel, the effect of teeth or pole pieces in reducing the air gap is extremely small.

The invention, therefore, provides an electromagnetic stirring apparatus for a continuous casting, steel mold comprising a set of windings and a magnetically permeable path extending about said windings and about the mold, the windings and path being designed for producing a rotating field in the mold to produce such magnetic stirring; wherein said magnetically permeable path is totally located outside said windings; in other words: the magnetically permeable path does not include pole pieces or teeth extending radially inward between said windings toward said mold.

Another facet of the invention derives from the fact that the means for producing the magnetic field does not require radially (relative to the mold) directed pole pieces, teeth or equivalent. This allows the windings to be effectively disposed in the form of a plurality of multiturn loops connected to carry electric current down one side of the mold, then approximately halfway about the mold, then up the opposite side, then approximately half way about the mold to the first side, and so on in repetition of the above path for the number of turns present in the multiturn winding. The result is a roughly multiturn loop, wound in a predetermined sense; which, with electric current therein, will produce flux across the mold, transverse to the steel movement direction and in a direction perpendicular to the median plane of the loop. A plurality (preferably two and, next in preference, three) of such multiturn loops are similarly disposed relative to the mold, at angular dispositions thereabout. When the energizing alternating currents are provided to the multiturn loops in the correct phase relationship, the effect of the flux fields is to produce the effect of a composite field through the steel and rotating about the steel travel direction in the mold, at a frequency determined by the energizing A.C. frequency and the number of multiturn loops. The invention, in this facet provides an efficient, economic, and compact structure due to the elimination of pole pieces and teeth and the winding arrangement.

This invention also provides an electromagnetic stirring apparatus wherein the windings are placed directly adjacent the mold sleeve. The mold sleeve is contained in the water jacket which extends about the outside of the mold. The sleeve is designed to surround the mold and to be narrowly spaced therefrom to define a narrow water layer between mold and sleeve. The sleeve is non-magnetic and preferably non-conducting being preferably constructed of plastic or of stainless steel. By the term "plastic" herein, I include fibreglass although, as well known it contains glass filaments. Fibreglass is one of the preferred construction materials for the sleeve. By the term "winding" in this application I include the conductor, its insulation and protective cover and, if a number of conductors are formed in a bundle, the means for maintaining the arrangement of such bundle. The windings, applied directly to the sleeve do not have magnetically permeable material in the form of teeth, pole pieces or the like between them. It is therefore possible to get more ampere turns in the same space than with prior designs and the cost of the assembly is decreased since the design is simplified. The sleeve may be indented to form recesses to at least partially receive the windings. In electromagnetic stirring apparatus a magnetically permeable path surrounds the windings. In the inventive arrangement the material forming such path is preferably used to assist in retaining the windings on the sleeve. Preferably, in one alternative, such path is formed in the inventive construction by winding steel strapping, of suitable magnetic permeability, about the windings. The assembly comprising: sleeve, windings, and strapping; is designed to be contained in the water jacket customarily provided. Such strapping, as previously implied, may be used as part of the means to hold the windings in place.

By the term "non-magnetic" in relation to this application, I include not only plastics but substantially non-magnetic metals including stainless steel. Stainless steel with fibreglass, constitutes, herein one of the preferred non-magnetic materials from which the mold sleeve may be made.

By the term "non-conducting" in relation to this application, I include plastics. Stainless steel, although of higher resistivity than copper is a conducting material and is so considered in the terminology of this application.

Other advantages of the invention, both generally and with reference to the specific embodiments, will be discussed hereafter.

Figure 2:
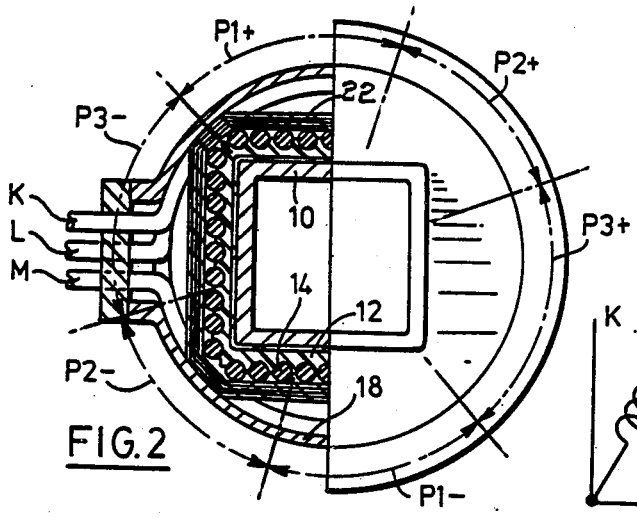
Figure 1A:
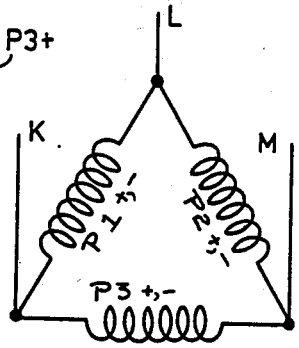
Figure 1B:
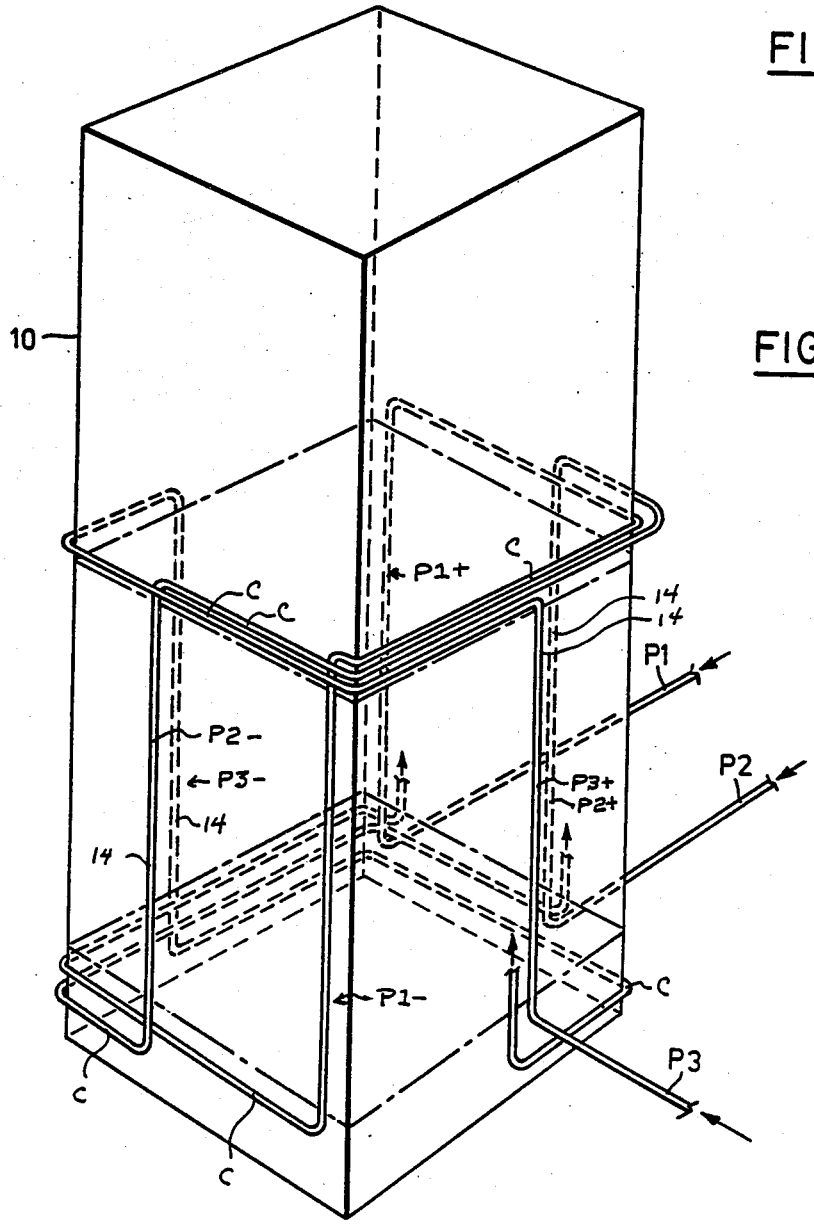
Figure 3:
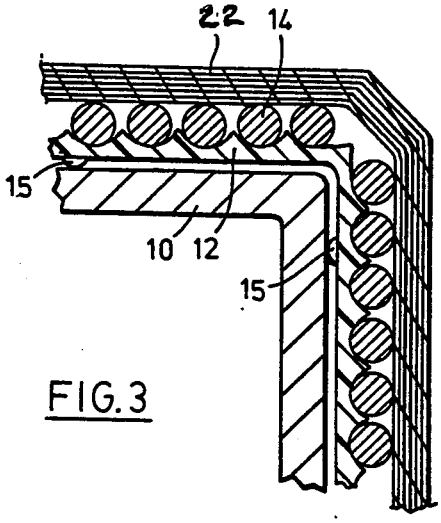
Figure 4:
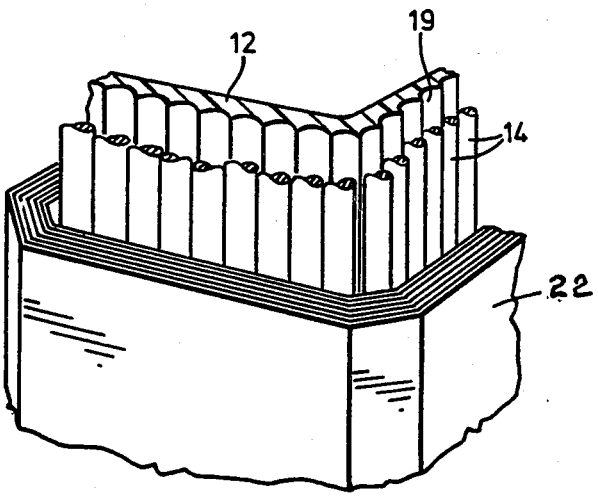
Figure 6:
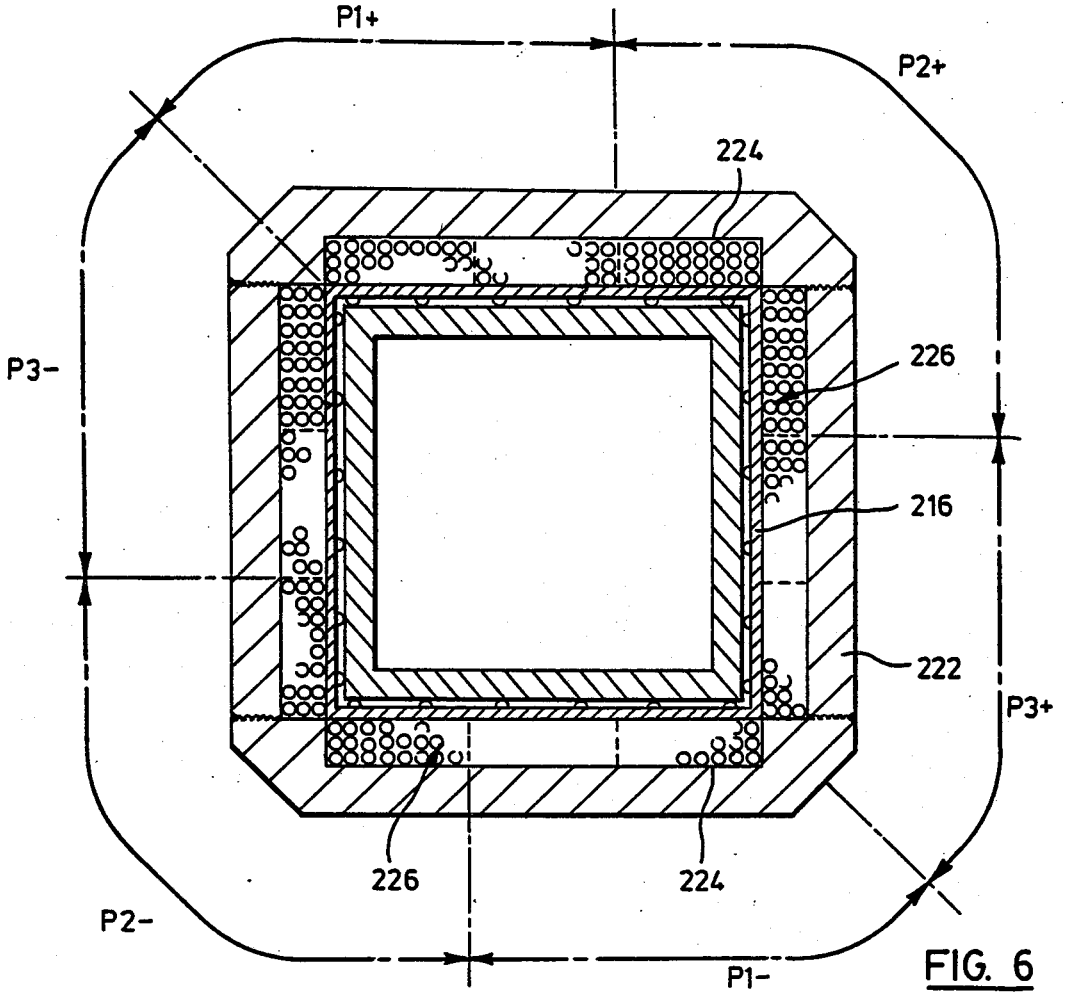
Figure 5:
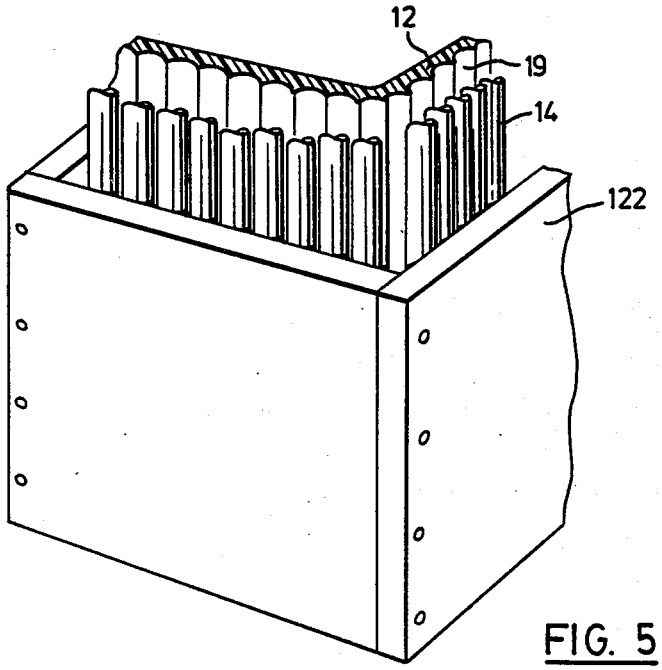
Figure 7:
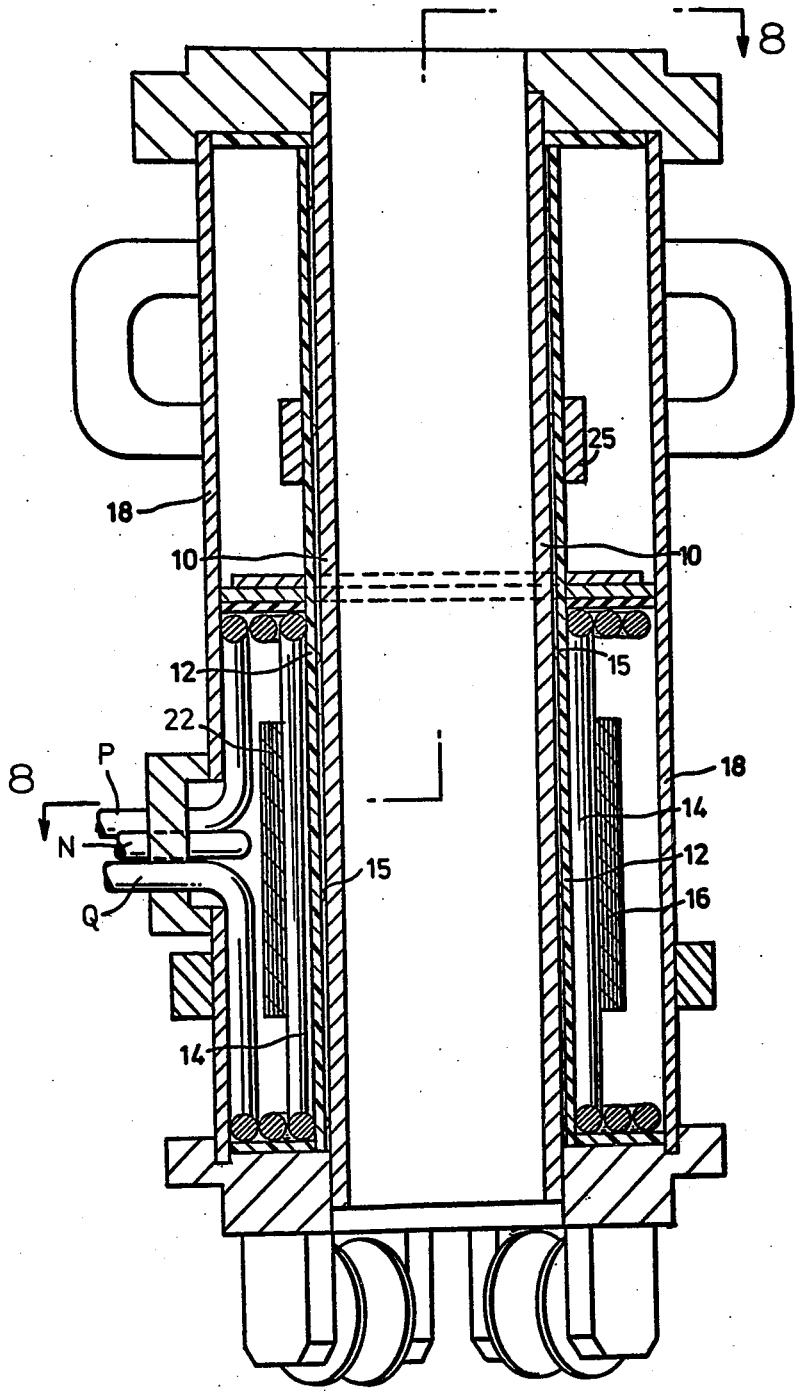
Figure 8:
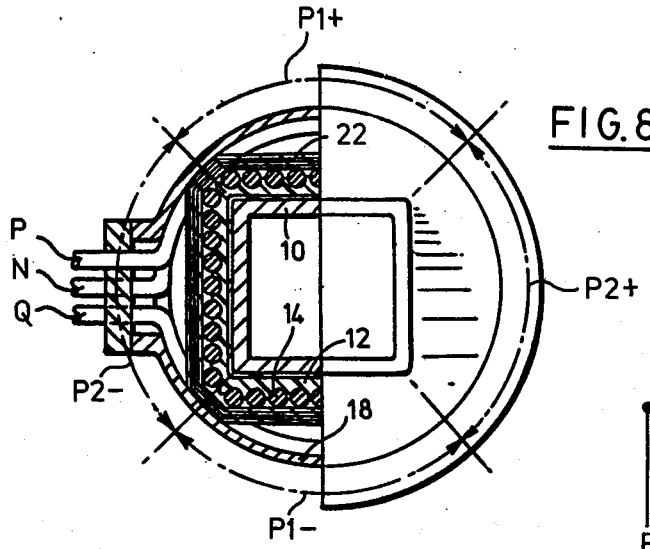
Figure 7A:
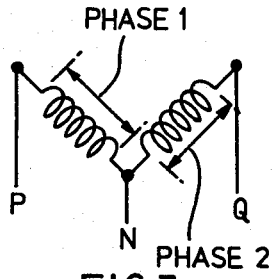
Figure 7B:
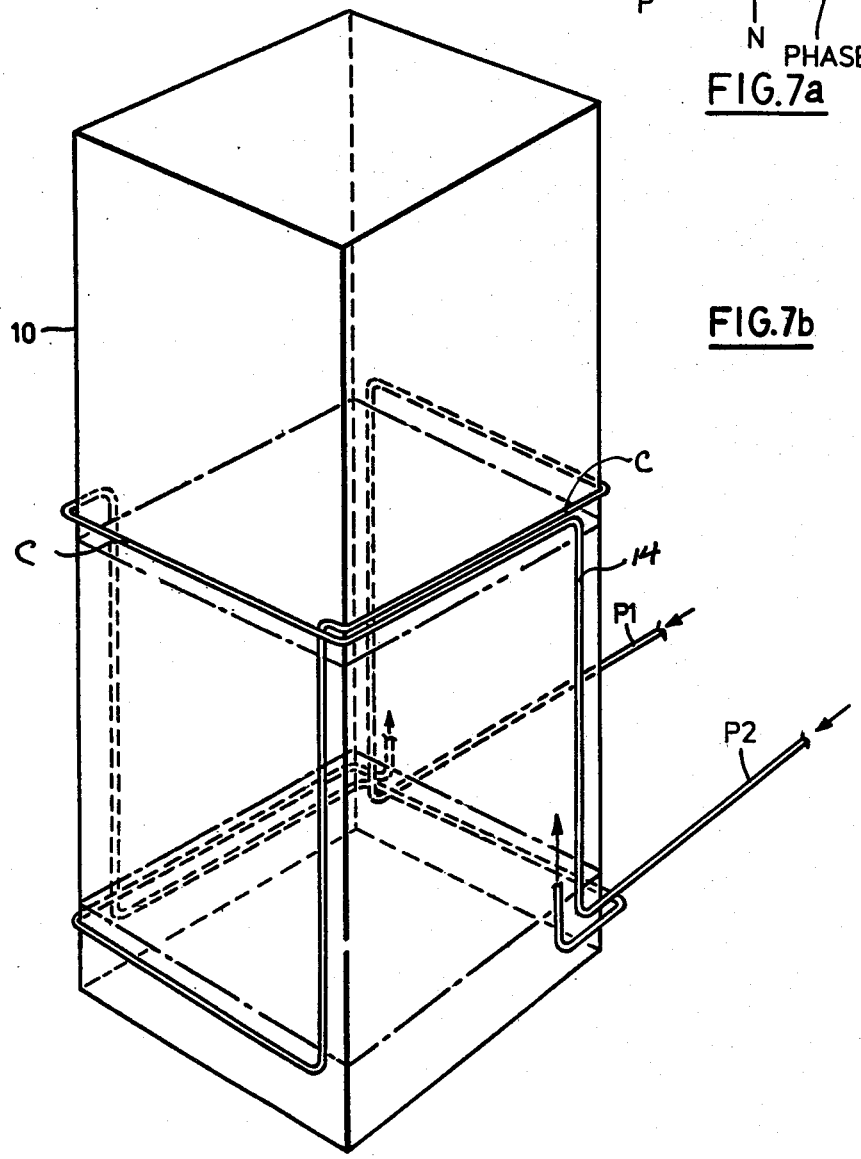
Figure 9:
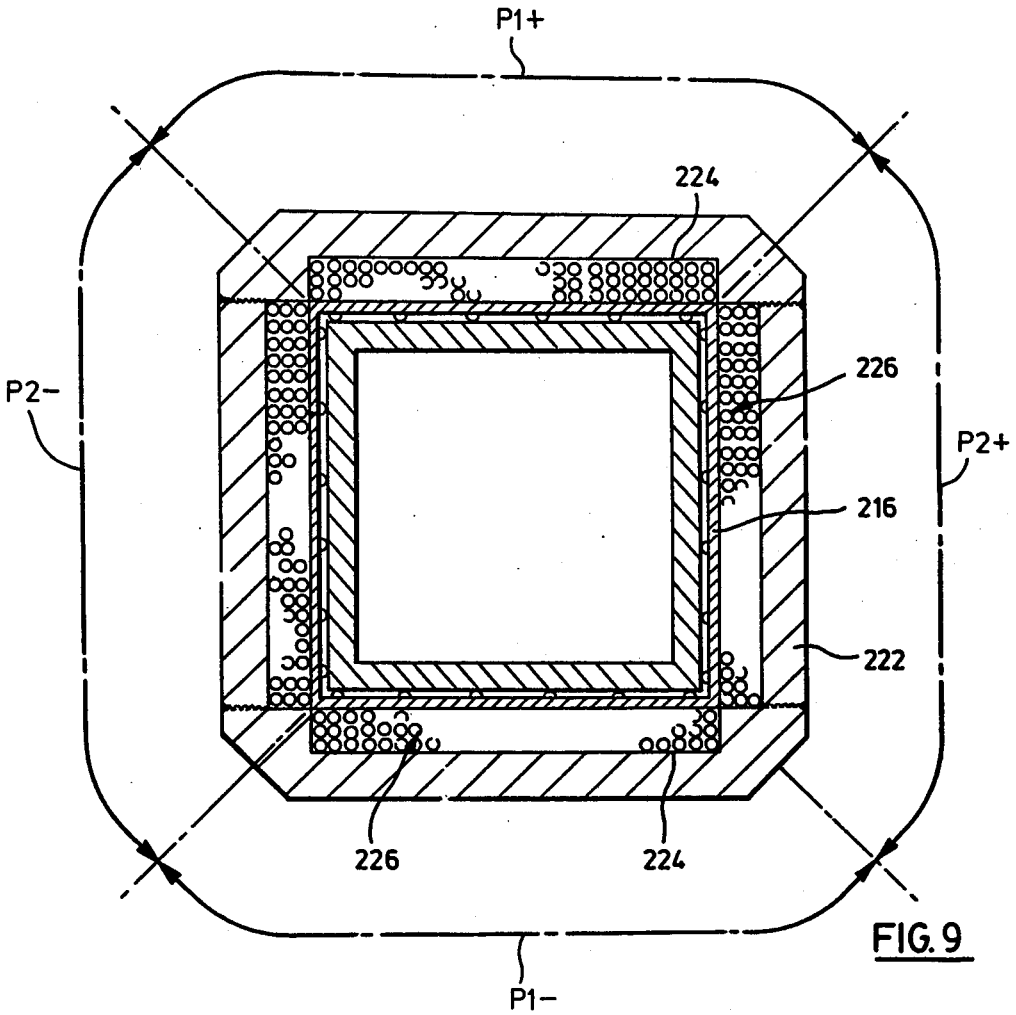

In drawings which illustrate a preferred embodiment of the invention:

FIG. 1 shows a side cross-section of a mold indicating the inventive stator in place thereon, FIGS. 1A and 1B indicate schematically, the stator winding arrangement, FIG. 2 shows a cross-section of the mold and stator along the lines 2—2 of FIG. 1, FIG. 3 shows an enlargement of a portion of the cross-section of FIG. 2, FIG. 4 shows a perspective view showing the application of steel strapping to the outside of the windings, FIG. 5 is a perspective view of similar attitude to FIG. 4 but showing the use of a bolted magnetically permeable path, FIG. 6 is a horizontal cross-section of an alternate arrangement of the magnetically permeable path and windings, FIG. 7 shows a side cross-section of a mold where the parts are physically identical to FIG. 1 but the input electrical leads are differently labelled for the description of two phase operation, FIGS. 7*a* and 7*b* show, schematically, the stator winding arrangement for two phase operation, FIG. 8 shows a cross-section of a mold along the lines 8—8 of FIG. 7. The parts physically shown in FIG. 8 are identical to those shown in FIG. 1. FIG. 8 however shows schematic labelling indicating the winding turn allocation for two rather than three phase operation, FIG. 9 is a horizontal cross-section of an alternate arrangement of the magnetically permeable path and windings. FIG. 9 shows members physically identical to FIG. 6 but shows schematic labelling indicating the winding turn allocation for two rather than three phase operation.

In the drawings:

FIG. 1 shows a mold for the continuous casting of steel, wherein the copper mold wall 10 is designed to receive molten steel at its upper end and to provide, from its lower end, steel which is solid at least on the outer skin. The mold is water cooled and the thickness of the outer skin therefore grows in thickness with the passage of the steel therethrough from the top to the bottom of the mold. All this is well known to those skilled in the art including the provision of a water jacket 18 means for circulating cooling water in the jacket including a sleeve 12 which is narrowly spaced from the wall of the mold. The designed circulation path and circulating means for the water in the jacket are not shown completely as they are well known to those skilled in the art.

In accord with the invention the sleeve 12 is not only constructed of non magnetic material but preferably of non conducting material, here fibreglass, and is provided with spaced small inward projections 15 to establish the mold sleeve spacing. It will be noted that the use of a sleeve material which is non-conducting as well as non-magnetic prevents the development of eddy currents in the sleeve and thus strengthens the effective value of the magnetic field in the mold.

As shown in FIG. 4, the outer surface of the sleeve is shaped to define vertically extending grooves 19 which are shaped to partially receive winding segments 14 shown as circles in cross-section therein. Each winding segment 14 may represent a single insulated conductor of a bundle of conductors. Moreover the outer shape of the conductor or bundle of conductors may be of other than circular shape and the outer shape of the sleeve complementarily contoured to receive such windings or bundles.

The winding segments in one embodiment 14 are arranged in three phases as indicated in FIG. 2. As indicated in FIG. 1*b*. Such windings for a single phase, e.g. "P1+" and "P1−" are electrically part of a multiturn winding where the segments 14 are arranged to carry current down one side of the mold (as indicated by the − sign) approximately half-way about the mold and up the opposite side (as indicated by the + sign), then approximately half-way about the mold to the first side and so on for the same manner for the number of turns in the multiturn winding.

The path of a single turn of the phase 1 winding is shown and the remaining phase 1 windings (alongside that shown as indicated in FIG. 2) are omitted for clarity in FIG. 1*a*. FIG. 1*a* shows a similar single turn of the phase 2 and phase three windings. FIG. 1 does not indicate the connections of the windings to each other as this is well known to those skilled in the art and shown schematically in FIG. 1*a*. The winding segments are connected above and below the vertical extents shown, by connections C (only schematically shown) on one or the other sides of the mold path so that for each phase there is a multiturn winding, wound and energized in a sense to direct magnetic flux across the steel path in the mold in a direction determined by the orientation of the winding and in an instantaneous sense and of strength determined by the phase of the current in the winding. In this embodiment three such windings are provided, angularly arranged about the mold. The multiturn windings are, as previously indicated, energized by a three phase source, labelled phase 1+, phase 2+, and phase 3+, phase 1− etc., where each phase of the current in each phase of winding segments will be 120° from the next. The current in the winding segments labelled 'phase 1+' is considered to be in phase with the current in the winding segments labelled 'phase 1−', which are located on the opposite side of the mold, in the sense that it is the same current which is energizing these opposite segments. The current in opposite segments is 180° out of phase in the sense that, relative to the axis of the mold, the currents in opposed segments are running in opposite directions. A similar relationship exists between the positive and negative sides of the phase 2 and phase 3 segments. In view of the phase relationship of the three phase currents, the magnetic flux fields rotate in the mold at a rate proportional to the frequency of the three phase supply. With the winding arrangement shown, there is produced, in the mold, a magnetic field rotating about an axis parallel to the steel path, where the rotation frequency is that of the A.C. frequency of the three phase supply. As is well known with other winding arrangements, the rotational frequency may be designed to be different from the A.C. frequency.

As shown schematically in FIG. 1*a* the three multiturn windings are preferably delta connected to three phase A.C. by leads K, L, M which leads are also indicated in FIGS. 1 and 2.

As best shown in FIG. 4 the magnetically permeable path is preferably provided by steel strapping 22 about the outside of the windings to provide the magnetically permeable path extending thereabout. As shown, the strapping also acts to maintain the windings mechanically in place. Other means not shown may be used to mechanically support the windings.

FIG. 5 shows an alternative means of forming the magnetically permeable path to that shown in FIGS. 1–4, the remaining elements of the developments being the same as those shown in FIGS. 1–4.

The alternative of FIG. 5, instead of using strapping to form the magnetically permeable path, uses plates of magnetically permeable iron, bolted together to form a path over the same vertical extent subject to variation for particular applications as the strapping of FIG. 1. The plates 122 may, like the strapping, be used to retain the windings 14 in position on sleeve 12. Sleeve 12 is located on mold wall 10 as in FIG. 1.

The bolted plates 122 have the advantages over the strapping 22 in being easier to assemble and disassemble for construction or repair. The strapping in some cases will allow economy of iron since, with the strap laminations extending longitudinally in the direction of flow of magnetic flux about the coil assembly, somewhat less material may be needed in some applications.

It will be noted that, although a fibreglass sleeve is preferred in the embodiments of FIGS. 1–4, on the one hand, and FIG. 5 on the other, a stainless steel sleeve may be used, with the realization that the rotating magnetic field applied to the mold will be somewhat diminished in the conducting (although non-magnetic) stainless steel sleeve.

FIG. 6 shows an alternative wherein the magnetically permeable path is provided by a magnetically permeable iron weldment 222. This weldment will, subject to variation for particular applications have the same vertical extent as the path forming members 22 and 122 in other embodiments. The weldment 222 is shaped as shown in FIG. 6 to provide, on each side of a square or rectangular mold wall and corresponding sleeve, a recess 224 extending along each side of the square or rectangular mold wall, for group of windings 226 suitably arranged (here) for three phase operation and designed to be connected to provide the rotating field. The arrangement allows for the compact housing of a large number of windings. A thin retainer layer of insulation (not shown) may be provided over the inner surface of each of the envelopes of windings 226 along each side. The sleeve 216 is not scalloped and may be made of stainless steel or plastic. The mold and mold wall water jacket used with the alternative of FIG. 6 may be the same as illustrated in FIG. 1.

Although the preferred forms of the invention shown indicate inwardly directed bumps 15 on the sleeve 12 or 216 to achieve spacing from the mold wall 10, it will be noted that I also contemplate using the alternative where the spacing is achieved by outwardly directed projections on the mold wall 10 contacting an inwardly smooth sleeve 12 or 216; or where the spacing is otherwise achieved.

The three embodiments shown all provide a magnetically permeable path surrounding the windings, where the path is not provided with pole pieces, teeth or equivalents projecting inwardly through the windings, but where the magnetically permeable path is wholly outside the windings.

This continuation-in-part has as its principal purpose the full presentation of this development with two phase operation. Three phase operation, as described in the previous page, represents an efficient use of electrical power as is well known from basic electrical power theory. However many of the molds with which the invention is used are four sided, i.e. either square or rectangular. With such four sided molds the wiring for three phase operation is complex since the winding extents do not correspond to the mold sides. Moreover with the turns of a phase extending about corners of a mold the application of classic electro-magnetic theory is difficult and practical results are difficult to predict. For these reasons and due to the large proportions of square or rectangular molds, it is believed that the two phase arrangement hereinafter described will be more commonly used than three or larger number phase arrangements.

The winding turns may be arranged so that there is one phase per side on a rectangular mold. With a rectangular mold an effort will usually be made to balance the field effects on the long and the short sides of the rectangle. Thus the turns on the long sides of the rectangle may, if desired, be arranged in an arrangement where the turns on the long side of the rectangle encompass the same geometrical envelope as the turns on the short side, i.e. the winding envelope does not encompass as much of the length of the long sides as of the short.

In FIG. 7 the physical arrangement of the coils and the mold is identical to FIG. 1. However for the two phase connection the exterior connections are labelled P, N and Q. As FIG. *7a* indicates, the coil turns will be connected so that phase 1 will be applied across leads P-N and phase 2 will be applied across leads Q-N. Phase 1 and phase 2 will be 90° out of phase as would be expected for two phase operation. FIG. 8 is physically identical to FIG. 2 but the windings are connected in a two phase relationship with opposite sides of the mold corresponding to a phase. The preferred winding arrangement for the phase distribution in FIG. 8 is shown in FIG. *7b*. Such windings for a single phase e.g. "P1+" and "P1−" are electrically part of a multiturn winding where the segments 14 are (as in previous embodiments) arranged to carry current down one side of the mold (as indicated by the − sign approximately half-way about the mold and up the opposite side as indicated by the + sign) then approximately half-way about the mold to the first side and so on in the same manner for the number of turns in the multiturn winding.

The path of a single turn of the phase 1 winding is shown and the remaining phase 1 windings (alongside that shown as indicated in FIG. 8) are omitted for clarity in FIG. *7a*. FIG. *7b* shows a similar single turn of the phase 2 winding. FIG. 7 does not indicate the connections of the windings to each other as this is well known to those skilled in the art and shown schematically in FIG. *7a*. The winding segments are connected above and below the vertical extents shown by connections C (only schematically shown) on one or the other side of the mold path so that for each phase there is a multiturn winding, wound and energized in a source to direct magnetic flux across the steel path in the mold in a direction determined by the orientation in the winding and in an instantaneous sense and of strength determined by the phase of the current in the winding. In this embodiment two such windings are provided, each such winding corresponding to the opposite sides of the mold. The multiturn windings are, as previously indicated, energized by a two phase source, labelled phase 1+, phase 2+, phase 1−, phase 2− where each phase of the current in each phase of winding segments will be 90° from the next. The current in the winding segments labelled 'phase 1+' is considered to be in phase with the current in the winding segments labelled 'phase 1−', which are located on the opposite side of the mold, in the sense that it is the same current which is energizing these opposite segments. The current in opposite segments may be considered to be 180° out of phase in the sense that, relative to the axis of the mold, the currents in the opposite segments are running in opposite directions. A similar relationship exists between the positive and negative sides of the phase 2 segments. In view of the phase relationship of the two phase currents, the magnetic flux fields rotate in the mold at a rate proportional to frequency of the two phase supply. With the winding arrangement shown, there is produced, in the mold, a magnetic field rotating about an axis parallel to the steel path, where the rotation frequency is that of the A.C. frequency of the two phase supply. As is well known with other winding arrangements the rotational frequency may be designed to be different from the A.C. frequency.

As shown schematically in FIG. 7*a* the two multiturn windings are connected to two phase A.C. by leads P, N, Q which leads are also indicated in FIGS. 7 and 8.

FIGS. 4 and 5 apply equally to the two phase arrangement of FIGS. 7 and 8 as to the arrangement of FIGS. 1 and 2. Hence the description of FIGS. 4 and 5 applies to the two phase arrangement.

FIG. 9 shows an alternative which is identical to that described in connection with FIG. 6. However the alternative of FIG. 9 is indicated as wound for two phase operation, with each phase corresponding to opposite sides of the mold. Thus the embodiment of FIG. 9 is wound by analogy to the arrangement demonstrated in FIG. 7*b* with the winding system for each phase being continued until the desired depth of windings is obtained.

I claim:

1. Means for electromagnetic rotary stirring in combination with a continuous casting mold for steel, defining a steel movement direction therein, comprising:

groups of winding segments, each group comprising a plurality of adjacent winding segments located outside said mold and extending in a longitudinal direction over a predetermined extent therealong, and each group being paired with a similar group of winding segments located approximately on the opposite side of said mold, connections adjacent the one and the other end of said extent connecting winding segments of one paired group in series with winding segments of the other paired group such that electrical energization may be applied to the winding segments to cause current to flow in one direction in the group on one side of said mold and in the other direction in said paired group on the other side of said mold where at least two such pairs of groups are provided with the groups in such pairs angularly disposed from one another in the same sense on opposite sides of said mold.

2. Means as claimed in claim 1 including means defining a path of magnetically permeable material extending about said winding segments and substantially totally located outside of said segments.

3. Means as claimed in claim 2 including a water jacket surrounding said winding segments and said magnetic path.

4. Means as claimed in claim 2 including a mold sleeve of non-magnetic material designed to overlie an extent of said mold and said winding segments are mounted about said sleeve.

5. Means as claimed in claim 3 including a mold sleeve of non-magnetic material designed to overlie an extent of said mold and said winding segments are mounted about said sleeve.

6. Means as claimed in claim 4 wherein said sleeve is indented to form recesses for at least partially receiving said winding segments.

7. Means as claimed in claim 5 wherein said sleeve is indented to form recesses for at least partially receiving said winding segments.

8. Means for electromagnetic rotary stirring of steel in combination with a continuous casting mold for such steel comprising:

at least two multi-turn conducting loops, each turn comprising a winding segment running longitudinally along said mold and connected in series to a winding segment running longitudinally along the approximately opposite side of said mold, whereby a group of said winding segments corresponding to each loop is disposed on the approximate opposite side of said mold, from another group of winding segments corresponding to the same loop, the groups of winding segments corresponding to a loop being each angularly disposed from groups corresponding to the other said loops in the same angular sense on opposite sides of the mold.

9. Means as claimed in claim 8 including means defining a path of magnetically permeable material extending about said winding segments and substantially totally located outside of said segments.

10. Means as claimed in claim 9 including a water jacket surrounding said winding segments and said magnetic path.

11. Means as claimed in claim 9 including a mold sleeve of non-magnetic material designed to overlie an extent of said mold and said winding segments are mounted about said sleeve.

12. Means as claimed in claim 10 including a mold sleeve of non-magnetic material designed to overlie an extent of said mold and said winding segments are mounted about said sleeve.

13. Means as claimed in claim 11 wherein said sleeve is indented to form recesses for at least partially receiving said winding segments.

* * * * *